US012075934B2

(12) United States Patent
Haskins

(10) Patent No.: US 12,075,934 B2
(45) Date of Patent: Sep. 3, 2024

(54) CAN COOLER AND METHODS OF MAKING AND USING SAME

(71) Applicant: Real Value LLC, Moore, OK (US)

(72) Inventor: Nathaniel Haskins, Redding, CA (US)

(73) Assignee: Real Value LLC, Moore, OK (US)

( * ) Notice: Subject to any disclaimer, the term of this patent is extended or adjusted under 35 U.S.C. 154(b) by 0 days.

(21) Appl. No.: 17/507,435

(22) Filed: Oct. 21, 2021

(65) Prior Publication Data

US 2022/0117422 A1 Apr. 21, 2022

Related U.S. Application Data

(60) Provisional application No. 63/094,639, filed on Oct. 21, 2020.

(51) Int. Cl.

| | |
|---|---|
| ***A47G 23/02*** | (2006.01) |
| ***B65D 81/38*** | (2006.01) |
| ***F25D 3/08*** | (2006.01) |

(52) U.S. Cl.

CPC ..... *A47G 23/0266* (2013.01); *B65D 81/3881* (2013.01); *B65D 81/3886* (2013.01); *F25D 3/08* (2013.01); *A47G 2023/0275* (2013.01); *F25D 2331/805* (2013.01)

(58) Field of Classification Search

CPC ..... B65D 81/3879; B65D 81/3881; B65D 81/3883; B65D 81/3886; B65D 81/3869; B65D 81/3841; B65D 43/0225; B65D 43/0229; B65D 47/00; B65D 47/04; B65D 47/06; A47G 23/02; A47G 23/0266

See application file for complete search history.

(56) References Cited

U.S. PATENT DOCUMENTS

| | | | | |
|---|---|---|---|---|
| 4,771,911 | A * | 9/1988 | Morony | B65D 11/16 220/592.16 |
| 4,798,063 | A * | 1/1989 | Rimmer | F25D 3/08 62/457.4 |
| 8,534,345 | B1 * | 9/2013 | French | A47J 41/0094 165/10 |
| 2019/0263564 | A1 * | 8/2019 | Robertaccio | B65D 25/10 |
| 2021/0053743 | A1 * | 2/2021 | Briggs | B65D 43/0231 |
| 2022/0135314 | A1 * | 5/2022 | Ke | B65D 81/3841 220/739 |

* cited by examiner

*Primary Examiner* — Javier A Pagan
(74) *Attorney, Agent, or Firm* — Hall Estill

(57) ABSTRACT

The present disclosure is directed to can cooler for holding a can. The can cooler includes a vessel having a closed bottom end, an upper open end, a sidewall having an inner surface and an outer surface and a ring positioned about the upper open end. The ring having a plurality of ribs configured for holding the can in the vessel.

18 Claims, 6 Drawing Sheets

CAN COOLER AND METHODS OF MAKING AND USING SAME

CROSS REFERENCE TO RELATED APPLICATIONS/INCORPORATION BY REFERENCE STATEMENT

The present patent application claims priority to U.S. Provisional Patent Application U.S. Ser. No. 63/094,639, filed on Oct. 21, 2020, the entire contents of which is hereby expressly incorporated herein by reference.

FIELD OF THE INVENTION

The present invention relates generally to a can cooler for holding a can, and more particularly, but not by way of limitation, to an improved can cooler and methods of making and using the can cooler.

BACKGROUND OF THE INVENTION

People who currently desire to drink from cold, traditional aluminum cans but want to keep their hands warm and free from condensation currently have two options. First, they may purchase basic can coolers known as koozies, which are often made from a fabric, foam, or rubbery material. These products are usually thin and low profile, slide right on to aluminum cans, keep consumer's hands from getting cold from the aluminum can and free from condensation, and the good ones fit snuggly enough and with enough friction to prevent aluminum cans from falling out when the can cooler is turned upside down. These products fail, however, in that they offer very limited insulation to help keep beverages cold longer. Second, there are several vacuum insulated can coolers on the market which solve the problem of traditional koozie can coolers in that they help keep beverages cold longer. These products fail, however, in that they are usually not slim and low profile, do not slide right on to the aluminum can without some assembly by the consumer, and contain more than one part, which can be lost or broken.

To this end, although can coolers of the existing art are operable, the current can cooler market would benefit from a product that is slim and low profile which is both aesthetically pleasing and will fit a wider range of cup holders; slides right on to an aluminum can without extra parts or any assembly required, grips the aluminum can to keep it in the can cooler when the can cooler is upside down, and is vacuum insulated to keep the beverage in the aluminum can cold longer. It is to such a can cooler, and method of making and using, that at least one embodiment of the present disclosure is directed.

DETAILED DESCRIPTION OF THE INVENTION

Figure 1:
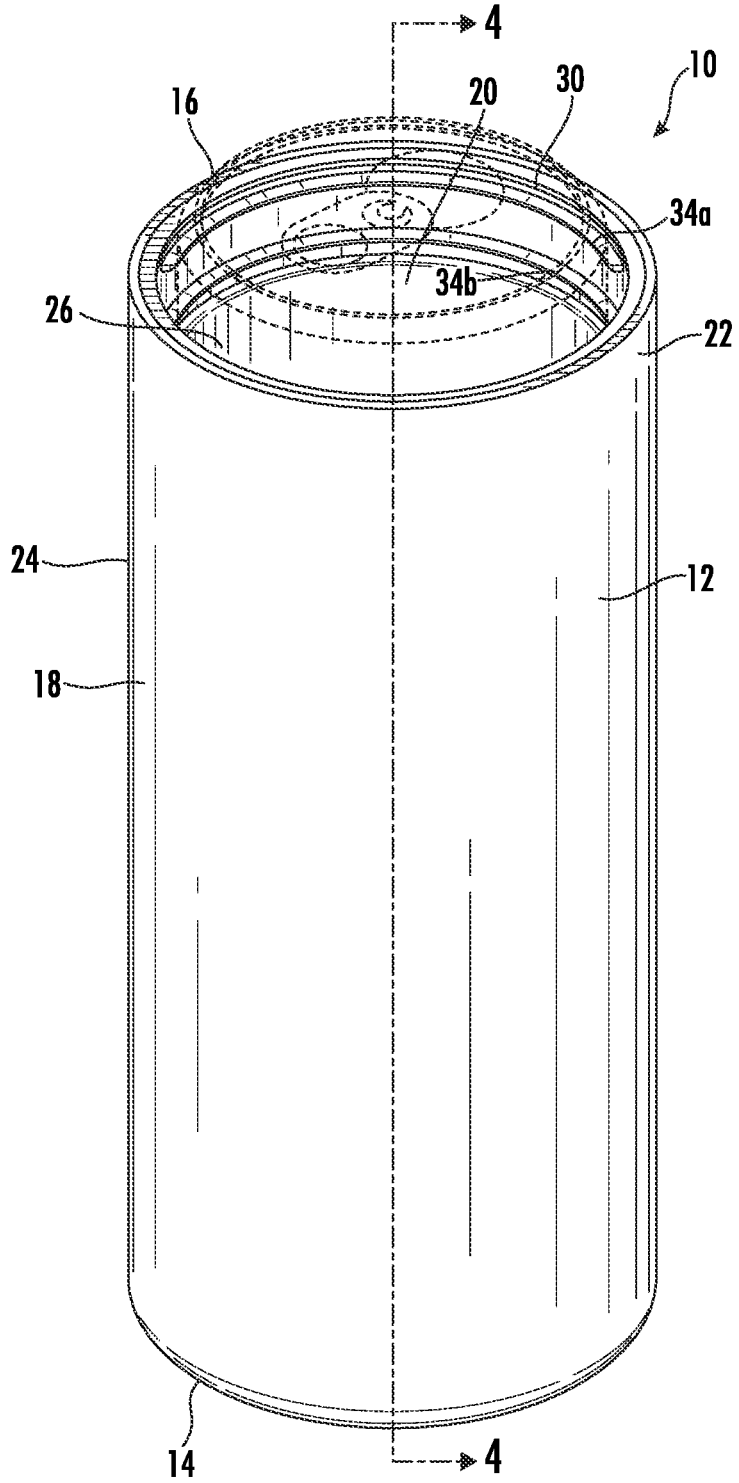
FIG. 1 is a perspective view of one embodiment of a can cooler, the can cooler constructed in accordance with the present disclosure.

Before explaining at least one embodiment of the inventive concept disclosed herein in detail, it is to be understood that the inventive concept is not limited in its application to the details of construction, experiments, exemplary data, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 2:
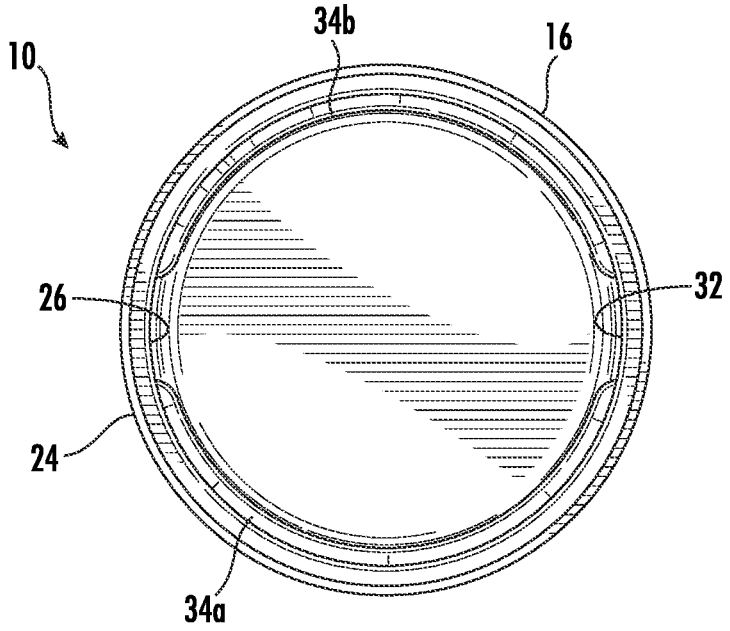
FIG. 2 is a top view of the can cooler of FIG. 1.
Figure 3:
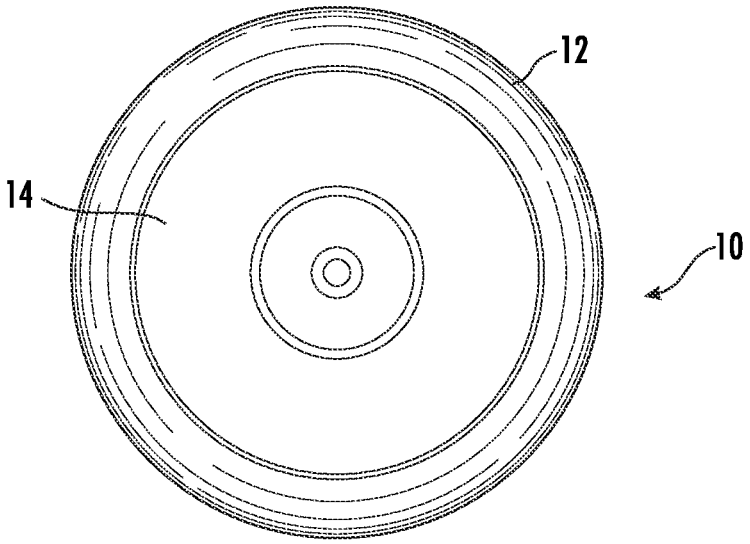
FIG. 3 is a bottom view of the can cooler of FIG. 1.
Figure 4:
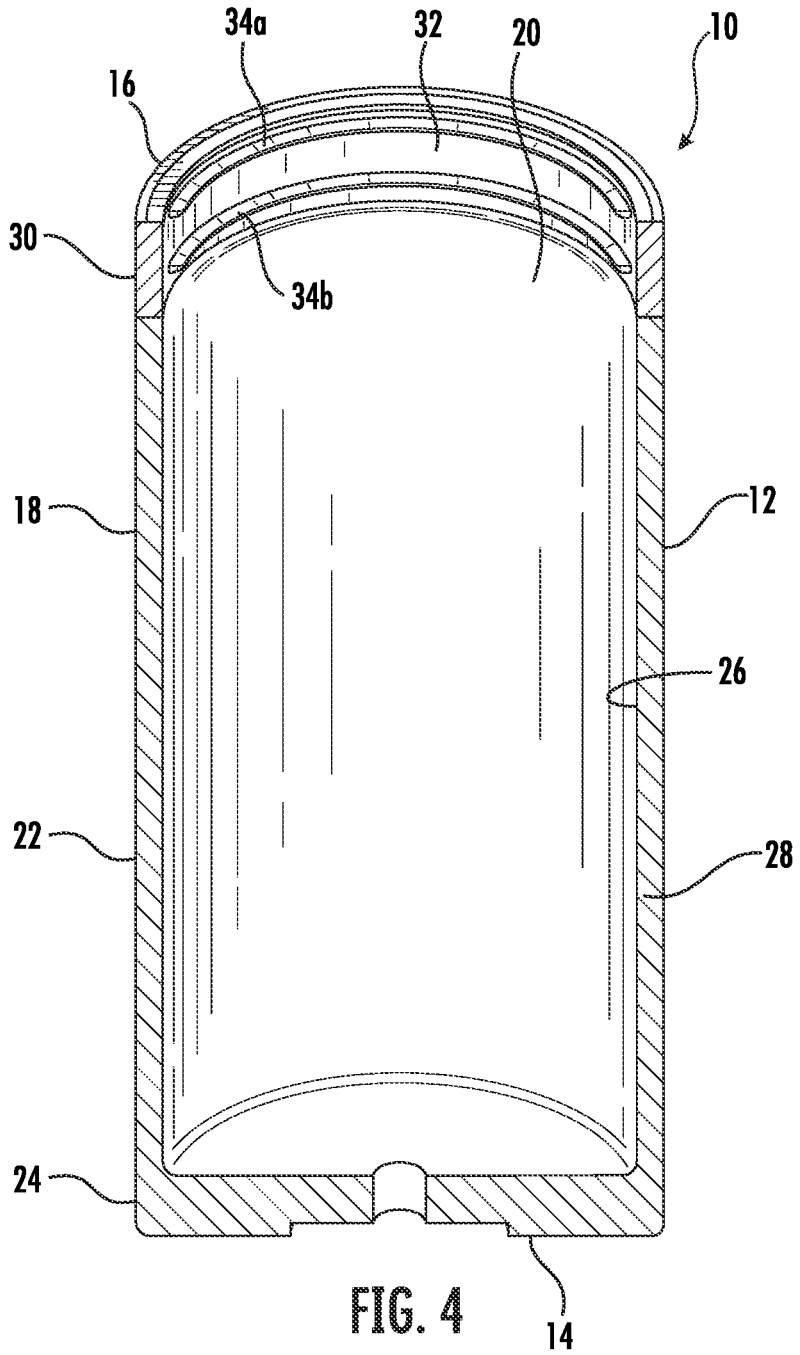
FIG. 4 is a cross-sectional view of the can cooler of FIG. 1.

Referring now to the drawings, and more particularly to FIGS. 1-4, one embodiment of a can cooler 10 is shown constructed in accordance with the present disclosure. It should be understood by one of ordinary skill in the art that the can cooler 10 may be sized and configured to be utilized with any type and shape of can or container so long as the can cooler 10 functions in accordance with the present disclosure as described herein. In one embodiment, as shown herein, the can cooler 10 is sized and configured to receive a slim can.

The can cooler 10 may be constructed from any material known by one of ordinary skill in the art which is strong and durable enough to cover an opening of a vessel, such as, polymeric materials, stainless steel, aluminum, silicone, or combinations thereof, or other such materials capable of being utilized in the construction of the can cooler 10. It should be understood by one of ordinary skill in the art that the can cooler 10 may be any variety of shapes, such as circular, square, cylindrical, coned, or the like, so long as the can cooler 10 functions in accordance with the present disclosure as described herein. It is contemplated, in one embodiment, that portions of the can cooler 10 are constructed as one piece, however, it should be understood that the can cooler 10 may be constructed from various components, from multiple pieces of material, or from combinations thereof.

The can cooler 10 includes a vessel 12 having a closed bottom end 14, an upper open end 16 and a sidewall 18 having an inner surface 20 and an outer surface 22.

The vessel 12 has an outer shell 24 and an inner shell 26 defining an insulating space 28 therebetween. In one embodiment, the inner shell 26 does not extend the entire length of the outer shell 24, but is configured to end a predetermined distance below the upper open end 16 of the vessel 12. As such, the insulating space 28 will be defined by the outer shell 24 and inner shell 26 to end a predetermined distance below the open upper end 16 of the vessel 12 to form a double wall. It should be understood that the insulating space 28 may contain a vacuum, partial vacuum, or an insulation substance or material, such as Styrofoam, foamed plastic, cotton, dry ice, a refrigerant, liquid or any other heat insulation member. Though one embodiment of the vessel 12 of the can cooler 10 is shown herein having an insulating space, it should be understood by one of ordinary skill in the art that other embodiments of the container of the can cooler may be provided that are non-insulating.

The vessel 12 of the can cooler 10 further has a ring 30 connected to a portion of the inner surface 20 of the sidewall 22. The ring 30 is provided with an inner surface 32. A plurality of ribs 34 (*a-b*) are formed on opposing sides of the inner surface 32 of the ring 30 so as to hold a can or other container in the vessel 12 and prevent the can or container from falling out of the can cooler 10. It should be understood by one of ordinary skill in the art that the plurality of ribs 34 (*a-b*) may be any size, number, shape, angle or configuration so long as the plurality of ribs 34 (*a-b*) function in accordance with the present disclosure. Further, it should be understood that the plurality of ribs may also be arranged in a variety of other ways such as aligned, uniform and the like, so long as the plurality of ribs function in accordance with the present disclosure as described herein.

The ring 30 may be formed of any variety of materials such as polymeric materials, stainless steel, aluminum, silicone, or combinations thereof. In one embodiment, the ring 30 is made of steel. Silicone is formed about the ring 30 so as to assist in gripping a can.

In one embodiment of forming the can cooler 10, in a first step, special glue (Hot-vulcanized adhesive) is added on the inside of the stainless steel ring 30. After the glue is added to the ring 30, the ring 30 is dried. The purpose is to make the steel ring 30 and silicone bond more firmly after the steel and silicone ring 30 is placed into a mold. It should be understood by one of ordinary skill in the art, any glue or substance may be utilized so long as the substance functions in accordance with the present disclosure.

In a next step, the stainless steel ring 30 (after dried) is placed into a mold. In one embodiment, a silicone material (Type: HeSheng silicone, 50° shoreness) is added into the mold together with the ring 30. When the ring 30 is taken out of the mold, the stainless steel ring 30 with silicone is finished.

The ring 30 is then pressed into the can cooler 10 with a fixed pneumatic press machine. It should be understood by one of ordinary skill in the art that any connecting member or method of connecting one object to another may be utilized for connecting the ring 30 to the vessel 12 of the can cooler 10.

Figure 5:
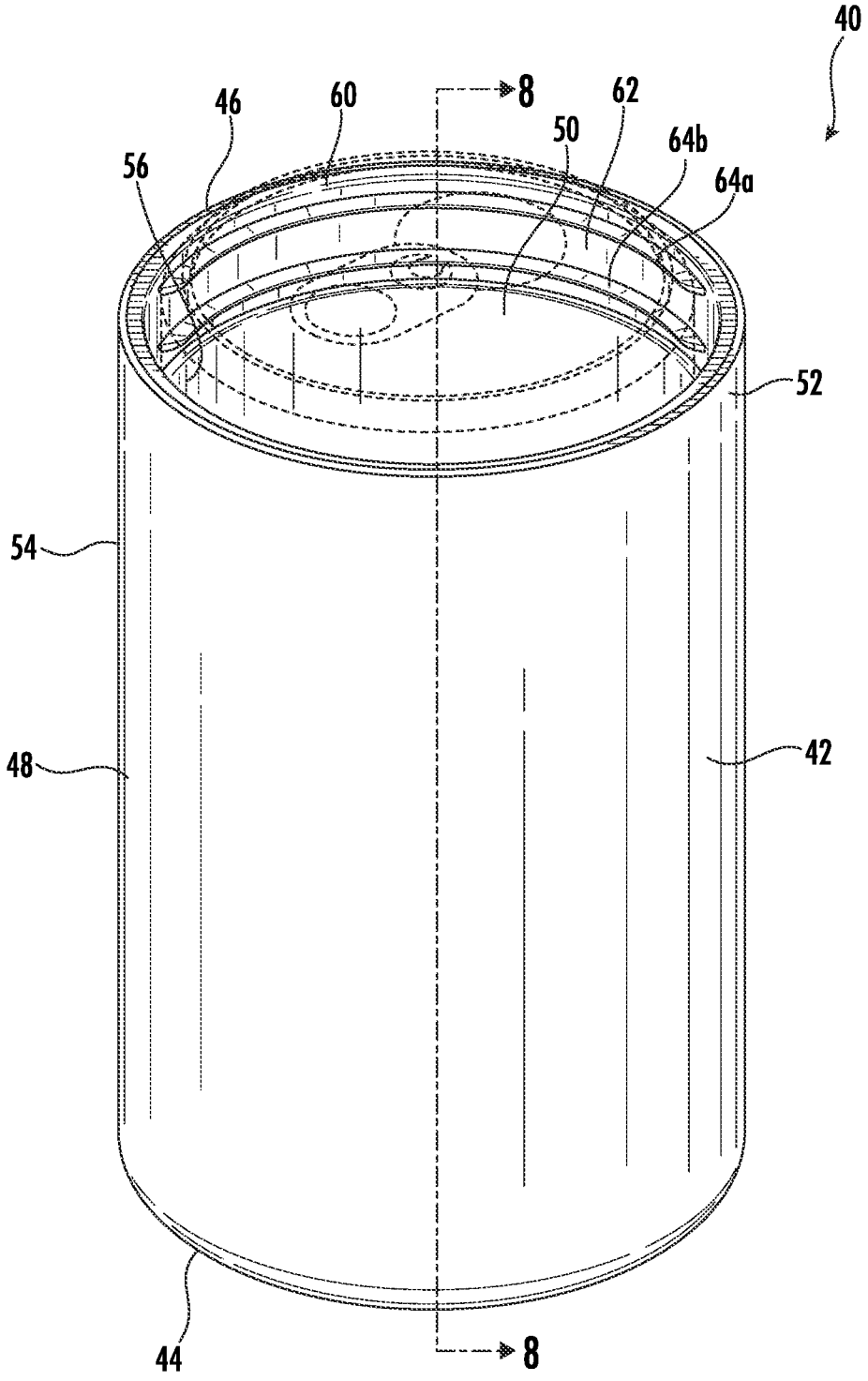
FIG. 5 is a perspective view of another embodiment of a can cooler, the can cooler constructed in accordance with the present disclosure.
Figure 6:
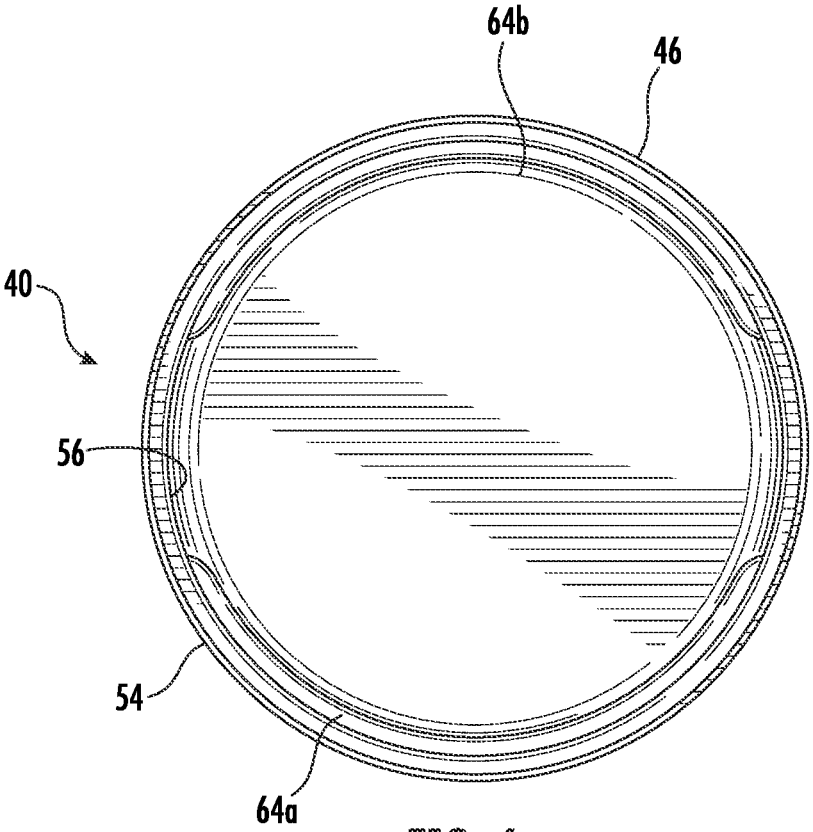
FIG. 6 is a top view of the can cooler of FIG. 5.
Figure 7:
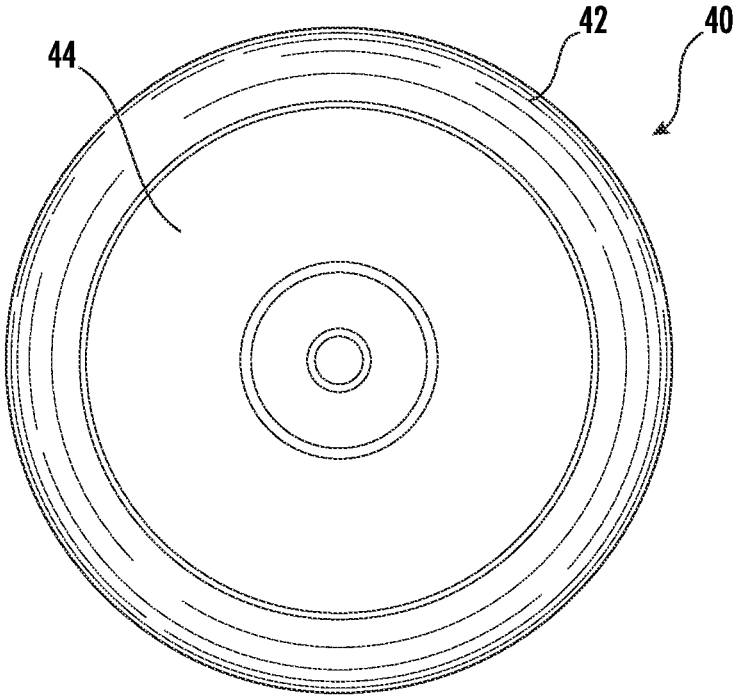
FIG. 7 is a bottom view of the can cooler of FIG. 5.
Figure 8:
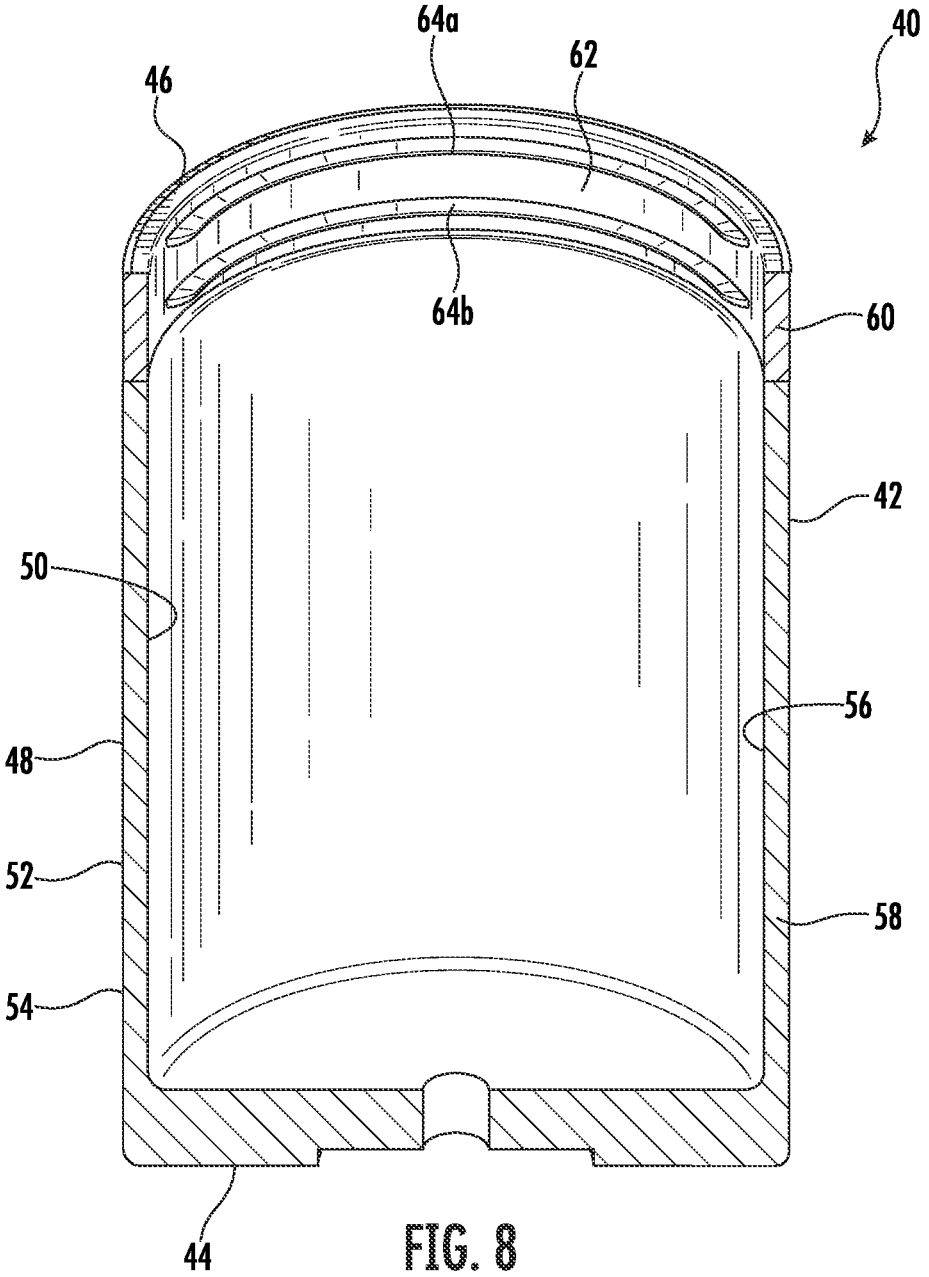
FIG. 8 is a cross-sectional view of the can cooler of FIG. 5.

Referring now to the drawings, and more particularly to FIGS. 5-8, another embodiment of a can cooler 40 is shown constructed in accordance with the present disclosure. As shown herein, the can cooler 40 is sized and dimensioned to receive a standard size can. However, it should be understood by one of ordinary skill in the art that the can cooler 40 may be sized and configured to be utilized with any type and shape of can or container so long as the can cooler 40 functions in accordance with the present disclosure as described herein. The can cooler 40 is constructed from similar materials as the can cooler 10.

The can cooler 40 includes a vessel 42 having a closed bottom end 44, an upper open end 46 and a sidewall 48 having an inner surface 50 and an outer surface 52.

The vessel 42 has an outer shell 54 and an inner shell 56 defining an insulating space 58 therebetween. In one embodiment, the inner shell 56 does not extend the entire length of the outer shell 54, but is configured to end a predetermined distance below the upper open end 46 of the vessel 42. As such, the insulating space 58 will be defined by the outer shell 54 and inner shell 56 to end a predetermined distance below the open upper end 46 of the vessel 42 to form a double wall. It should be understood that the insulating space 58 may contain a vacuum, partial vacuum, or an insulation substance or material, such as Styrofoam, foamed plastic, cotton, dry ice, a refrigerant, liquid or any other heat insulation member. Though one embodiment of the vessel 42 of the can cooler 40 is shown herein having an insulating space, it should be understood by one of ordinary skill in the art that other embodiments of the container of the can cooler may be provided that are non-insulating.

The vessel 42 of the can cooler 10 further has a ring 60 connected to a portion of the inner surface 50 of the sidewall 52. The ring 60 is constructed similar to the ring 30. The ring 60 is provided with an inner surface 62. A plurality of ribs 64 (*a-b*) are formed on opposing sides of the inner surface 62 of the ring 60 so as to hold a can or other container in the vessel 42 and prevent the can or container from falling out of the can cooler 40. It should be understood by one of ordinary skill in the art that the plurality of ribs 64 (*a-b*) may be any size, number, shape, angle or configuration so long as the plurality of ribs 64 (*a-b*) function in accordance with the present disclosure. Further, it should be understood that the plurality of ribs may also be arranged in a variety of other ways such as aligned, uniform and the like, so long as the plurality of ribs function in accordance with the present disclosure as described herein.

The method of making the can cooler 40 is similar to the method for making the can cooler 10.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. A can cooler for holding a can, comprising: a vessel having a body and a ring wherein the body has a closed bottom end, an upper open end, a sidewall having an inner surface and an outer surface and wherein the ring is positioned about the upper open end of the body, the ring having a first plurality of c-shaped, horizontal ribs and a second plurality of c-shaped, horizontal ribs; wherein the first plurality of c-shaped, horizontal ribs are vertically aligned with the second plurality of c-shaped, horizontal ribs, wherein each rib of the first plurality of c-shaped, horizontal ribs are located on opposing sides of an inside surface of the ring, wherein each rib of the second plurality of c-shaped, horizontal ribs are located on opposing sides of the inside surface of the ring wherein the first plurality of c-shaped, horizontal ribs and the second plurality of c-shaped, horizontal ribs are configured for holding the can in the vessel.

2. The can cooler of claim 1 wherein the vessel is cylindrical.

3. The can cooler of claim 1 wherein the vessel is constructed of stainless steel.

4. The can cooler of claim 1 wherein the vessel further comprising:

an outer shell and an inner shell defining an insulating space therebetween.

5. The can cooler of claim 4 wherein the inner shell is configured to extend from the closed bottom end to a predetermined distance below the upper open end of the vessel such that the insulating space defined by the outer shell and the inner shell ends a predetermined distance below the open upper end of the vessel.

6. The can cooler of claim 4 wherein the insulating space contains a vacuum.

7. The can cooler of claim 4 wherein the insulating space contains an insulation substance.

8. The can cooler of claim 1 wherein silicone is formed about an inner surface of the ring of the vessel.

9. The can cooler of claim 1 wherein the vessel is sized and configured to receive a slim sized can.

10. The can cooler of claim 1 wherein the vessel is sized and configured to receive a standard sized can.

11. A can cooler for holding a can, comprising: a vessel having a closed bottom end, an upper open end, a sidewall having an inner surface and an outer surface; and a ring positioned and connectable about the upper open end of the vessel, the ring having a first plurality of c-shaped, horizontal ribs and a second plurality of c-shaped, horizontal ribs; wherein the first plurality of c-shaped, horizontal ribs are vertically aligned with the second plurality of c-shaped, horizontal ribs, wherein each rib of the first plurality of c-shaped, horizontal ribs are located on opposing sides of an inside surface of the ring, wherein each rib of the second plurality of c-shaped, horizontal ribs are located on opposing sides of the inside surface of the ring wherein the first plurality of c-shaped, horizontal ribs and the second plurality of c-shaped, horizontal ribs are configured for holding the can in the vessel.

12. The can cooler of claim 11 wherein the vessel further comprising:

an outer shell and an inner shell defining an insulating space therebetween.

13. The can cooler of claim 12 wherein the inner shell is configured to extend from the closed bottom end of the vessel to a predetermined distance below the upper open end of the vessel such that the insulating space defined by the outer shell and the inner shell ends a predetermined distance below the open upper end of the vessel.

14. The can cooler of claim 12 wherein the insulating space contains a vacuum.

15. The can cooler of claim 12 wherein the insulating space contains an insulation substance.

16. The can cooler of claim 11 wherein silicone is formed about an inner surface of the ring.

17. The can cooler of claim 11 wherein the vessel is sized and (Original) configured to receive a slim sized can.

18. The can cooler of claim 11 wherein the vessel is sized and configured to receive a standard sized can.

* * * * *